US005474576A

United States Patent [19]

Thoen et al.

[11] Patent Number: 5,474,576

[45] Date of Patent: Dec. 12, 1995

[54] DETERGENT COMPOSITIONS INHIBITING DYE TRANSFER IN WASHING

[75] Inventors: Christiaan A. J. K. Thoen, Hassdonk; Adbennaceur Fredj; Regine Labeque, both of Brussel, all of Belgium

[73] Assignee: The Procter & Gamble Company, Cincinnati, Ohio

[21] Appl. No.: 307,735

[22] PCT Filed: Jan. 22, 1993

[86] PCT No.: PCT/US93/00626

§ 371 Date: Jul. 18, 1994

§ 102(e) Date: Jul. 18, 1994

[87] PCT Pub. No.: WO93/15176

PCT Pub. Date: Aug. 5, 1993

[30] Foreign Application Priority Data

Jan. 31, 1992 [EP] European Pat. Off. ..... 92870019

[51] Int. Cl.$^6$ ..... C11D 3/28; C11D 3/39; C11D 3/395; C11D 3/386

[52] U.S. Cl. ..... 8/111; 8/137; 252/102; 252/104; 252/174.12; 252/174.17; 252/186.29; 252/186.33; 252/186.43; 252/524; 252/542

[58] Field of Search ..... 8/111, 137; 252/102, 252/104, 174.12, 174.17, 186.29, 186.33, 186.43, 524, 542

[56] References Cited

U.S. PATENT DOCUMENTS

| | | | |
|---|---|---|---|
| 3,635,828 | 1/1972 | Benjamin | 252/99 |
| 3,640,877 | 2/1972 | Gobert | 252/99 |
| 3,932,295 | 1/1976 | Fujino | 252/102 |
| 4,077,768 | 3/1978 | Johnston | 8/107 |
| 4,399,049 | 8/1983 | Gray | 252/91 |
| 4,421,668 | 12/1983 | Cox | 252/174.12 |
| 5,194,416 | 3/1993 | Jureller | 502/167 |

FOREIGN PATENT DOCUMENTS

89/09813 10/1989 WIPO .

*Primary Examiner*—Dennis Albrecht
*Attorney, Agent, or Firm*—Jacobus C. Rasser; Jerry J. Yetter; Michael D. Jones

[57] ABSTRACT

A dye transfer inhibiting compositions are disclosed, comprising:

A. an metallo catalyst selected from
   a) metallo porphin and water-soluble or water-dispersable derivatives thereof;
   b) metallo porphyrin and water-soluble or water-dispersable derivatives thereof;
   c) metallo phthalocyanine and water-soluble or water-dispersable derivatives thereof;

B. an amine base catalyst stabilizer capable of binding to the 5th ligand of the metallo catalyst.

C. an enzymatic system capable of generating hydrogen peroxide.

22 Claims, No Drawings

DETERGENT COMPOSITIONS INHIBITING DYE TRANSFER IN WASHING

FIELD OF THE INVENTION

The present invention relates to a composition and a process for inhibiting dye transfer between fabrics during washing.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to bleach the fugitive dyes washed out of dyed fabrics before they have the opportunity to become attached to other articles in the wash.

Suspended or solubilized dyes can to some degree be oxidized in solution by employing known bleaching agents.

GB 2 101 167 describes a stable liquid bleaching composition containing a hydrogen peroxide precursor which is activated to yield hydrogen peroxide on dilution.

However it is important at the same time not to bleach the dyes actually remaining on the fabrics, that is, not to cause color damage.

U.S. Pat. No. 4,077,768 describes a process for inhibiting dye transfer by the use of an oxidizing bleaching agent together with a catalytic compound such as iron porphins.

Copending EP Patent Application 91202655.6 filed Oct. 9, 1991, relates to dye transfer inhibiting compositions comprising an enzymatic system capable of generating hydrogen peroxide and porphin catalysts.

It has now been found that certain amine base catalyst stabilizers when added to said enzymatic dye transfer inhibiting compositions enhances the overall performance of said compositions. The addition of said catalyst stabilizers reduces the rate of self-destruction of the porphin catalyst resulting in improved through-the-wash stability of the porphin catalyst. Also, improved whiteness benefits are obtained in the presence of catalyst stabilizers, due to a substantial reduction in the amount of porphin catalyst deposited onto the fabrics. Furthermore, it has been found that said catalyst stabilizers accelerate the oxidation reactivity of the porphin catalyst thereby increasing the rate of the dye bleaching.

Accordingly, a dye transfer inhibiting composition is provided which exhibits optimum dye transfer inhibiting properties.

According to another embodiment, the invention provides an efficient process for laundering operations involving colored fabrics.

SUMMARY OF THE INVENTION

The present invention relates to inhibiting dye transfer compositions comprising:

A. a metallo catalyst selected from
   a) metallo porphin and water-soluble or water-dispersable derivatives thereof;
   b) metallo porphyrin and water-soluble or water-dispersable derivatives thereof;
   c) metallo phthalocyanine and water-soluble or water-dispersable derivatives thereof;

B. an amine base catalyst stabilizer capable of binding to the 5th ligand of the metallo catalyst.

C. an enzymatic system capable of generating hydrogen peroxide.

According to another embodiment of this invention a process is also provided for laundering operations involving colored fabrics.

DETAILED DESCRIPTION OF THE INVENTION

The present invention provides a dye transfer inhibiting composition comprising:

A. a metallo catalyst selected from
   a) metallo porphin and water-soluble or water-dispersable derivatives thereof;
   b) metallo porphyrin and water-soluble or water-dispersable derivatives thereof;
   c) metallo phthalocyanine and water-soluble or water-dispersable derivatives thereof;

B. an amine base catalyst stabilizer capable of binding to the 5th ligand of the metallo catalyst.

C. an enzymatic system capable of generating hydrogen peroxide.

The Hydrogen Peroxide Precursor

The oxidizing agent, hydrogen peroxide is generated in situ by using an enzymatic hydrogen peroxide generation system.

The use of an enzymatic hydrogen peroxide generating system allows the continuous generation of low levels of hydrogen peroxide and provides a practical way of controlling a low steady-state level of hydrogen peroxide. Maximum effectiveness occurs when the component levels are such that the hydrogen peroxide is replenished at a rate similar to its removal due to the oxidation of dyes in the wash water. The enzyme used in the present invention is an oxidase. The oxidase is present by 0.1–20000 units, preferably 0.5 to 5000 units per gram of the composition. One unit is the amount of enzyme needed to convert 1 mol of substrate per minute.

Suitable oxidases are urate oxidase, galactose oxidase, alcohol oxidases, amine oxidases, amino acid oxidases, cholesterol oxidase and glucose oxidase, malate oxidase, glycollate oxidase, hexose oxidase, aryl alcohol oxidase, L-gulonolactose oxidase, pyranose oxidase, L-sorbose oxidase, pyridoxine 4-oxidase, 2-2-hydroxyacid oxidase, choline oxidase, ecdysone oxidase.

The preferred enzymatic systems are alcohol and aldehyde oxidases, glucose oxidase.

The more preferred systems for granular detergent application would have solid alcohols, e.g. glucose whose oxidation is catalysed by glucose oxidase to glucoronic acid with the formation of hydrogen peroxide.

The more preferred systems for liquid detergent application would involve liquid alcohols which could for example, also act as solvents. An example is ethanol/ethanol oxidase.

The quantity of oxidase to be employed in compositions according to the invention should be at least sufficient to provide in the wash a constant generation of 0.005 to 10 ppm AvO per minute. For example, with the glucose oxidase, this can be achieved at room temperature and at pH 6 to 11, preferentially 7 to 9 with 1–20000 U/l glucose oxidase, 0.005 to 0.5 % glucose under constant aeration in the washing process.

Metallo Catalyst

The preferred usage range of the catalyst in the wash is $10^{-8}$ molar to $10^{-3}$ molar, more preferred $10^{-6}$–$10^{-4}$ molar.

The essential metallo porphin structure may be visualized as indicated in Formula I in the accompanying drawings. In Formula I the atom positions of the porphin structure are numbered conventionally and the double bonds are put in conventionally. In other formula, the double bonds have been omitted in the drawings, but are actually present as in I.

Preferred metallo porphin structures are those substituted at one or more of the 5, 10, 15 and 20 carbon positions of Formula I (Meso positions), with a phenyl or pyridyl substituent selected from the group consisting of

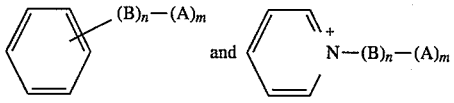

wherein n and m may be 0 or 1; A may be sulfate, sulfonate, phosphate or carboxylate groups; and B is $C_1$–$C_{10}$ alkyl, polyethoxy alkyl or hydroxy alkyl.

Preferred molecules are those in which the substituents on the phenyl or pyridyl groups are selected from the group consisting of —$CH_3$, —$C_2H_5$, —$CH_2CH_2CH_2SO_3$—, —$CH_2$—, and —$CH_2$ $CH(OH)CH_2SO_3$—, —$SO_3$ A particularly preferred metallo phorphin is one in which the molecule is substituted at the 5, 10 15, and 20 carbon positions with the substituent

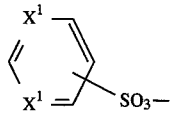

This preferred compound is known as metallo tetrasulfonated tetraphenylporphin. The symbol $X^1$ is (=CY—) wherein each Y, independently, is hydrogen, chlorine, bromine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

(I)

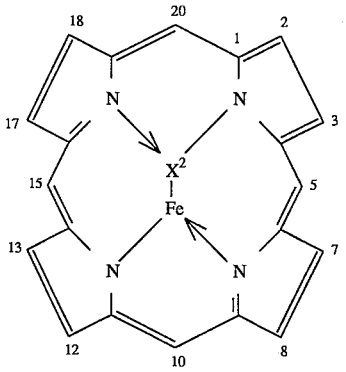

Porphin derivatives also include chlorophyls, chlorines, i.e, isobacterio chlorines and bacteriochlorines.

Metallo porphyrin and water-soluble or water-dispersable derivatives thereof have a structure given in formula II.

(II)

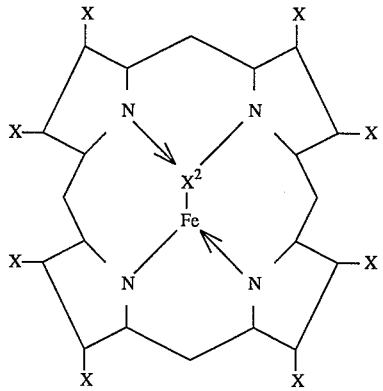

where X can be alkyl, alkyl carboxy, alkyl hydroxyl, vinyl, alkenyl, alkyl sulfate, alkylsulfonate, sulfate, sulfonate, aryl.

The symbol $X^2$ of Formula II represents an anion, preferably $OH^-$ or $Cl^-$.

The symbol X can be alkyl, alkylcarboxy, alkylhydroxyl, vinyl, alkenyl, alkylsulfate, alkylsulfonate, sulfate, sulfonate.

Metallo phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are metallo phthalocyanine trisulfonate and metallo phthalocyanine tetrasulfonate.

(III)

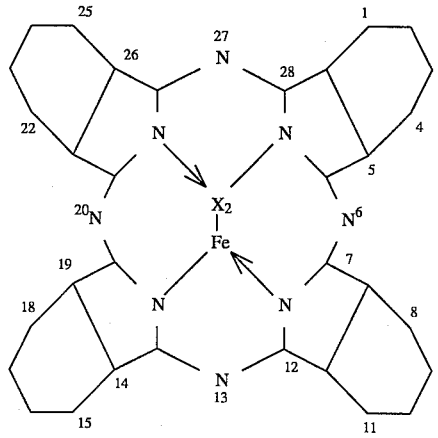

Another form of substitution possible for the present invention is substitution of the central metal by Fe, Mn, Co Rh, Cr, Ru, Mo or other transition metals.

Still a number of considerations are significant in selecting variants of or substituents in the basic porphin or azaporphin structure. In the first place, one would choose compounds which are available or can be readily synthesized.

Beyond this, the choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stains or stained surfaces and are therefore most likely not to cause attack on fixed dyes, whereas the cationic or zwitterionic compounds may be attracted to, or at least not repelled by such stained surfaces.

Amine Base Catalyst Stablizer

The dye transfer inhibiting benefits can be optimized by adding small amounts of catalyst stabilizers. It is well known in art that catalyst e.g. metallo porphins are susceptible to self-destruction. As a result of said selfdestruction, the level of catalyst should be such that sufficient active catalyst is present to bleach the dyes throughout the total wash cycle. It has now been found that the stability of metallo catalyst used in the present invention is improved by adding amine base catalyst stabilizers capable of binding the 5th ligand of the central atom in the metallo porphin structure. Preferred heterocyclic compounds suitable for the present invention are imidazole compounds of the formula:

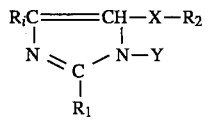

wherein Y is hydrogen or oxygen or a $C_1$–$C_{12}$ alkyl, $R_i$, $R_1$ and $R_2$ are selected independently hydrogen or $C_1$–$C_{30}$ alkyl or alkenyl groups, and X is selected from the group of:

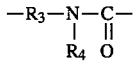

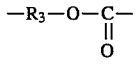

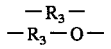

wherein $R_3$ is a $C_1$–$C_5$ alkanediyl group, or is

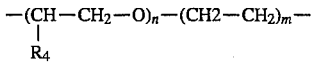

with n being an integer from 0 to 10, and m is an integer from 0 to 2, n+m>1, and $R_4$ being a $C_{1-4}$ alkyl group or hydrogen.

Most preferred are imidazole derivatives including histidine, purines, hipoxanthine, imidazolidicarboxylic acid, histamine, polyhistidine, alkylated imidazole.

Other heterocyclic compounds suitable for the present invention are pyridine and alkylated pyridines and derivatives thereof, pyrole and derivatives thereof.

Non heterocyclic compounds capable of binding the 5th ligand of the central atom in the porphin structure are suitable for the present invention.

These non heterocyclic compounds include non heterocyclic amines, having the formula $(C_2H_5)_3N$, $C_3H_7NH_2$, $(C_6H_{11})_2NH$, 1,5-diazabcyclo[4.3.0]non-5-ene.

Second, the catalyst stabilizers of the present invention reduce the deposition of the porphin catalyst onto the fabric, resulting in better whiteness maintenance of white fabrics. Also, it has been found that the addition of the catalyst stabilizers mentioned hereinabove not only results in less self-destruction of the structure but also results in less deposition of oxidized or non oxidized porphin.

Furthermore, it has been found that the rate of dye oxidation by the porphin catalyst is greatly enhanced by the presence of the said catalyst stabilizers. This results in an increased dye bleaching. The amine base catalyst stabilizer is present in a molar ratio of iron porphin to amine base catalyst from 1:1 to 1:5000, preferably from 1:1 to 1:2500.

The present compositions are conveniently used as additives to conventional detergent compositions for use in laundry operations. The present invention also encompasses dye transfer inhibiting compositions which will contain detergent ingredients and thus serve as detergent compositions.

Detergent Ingredients

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$– $C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are polyhydroxy fatty acid amide surfactants of the formula

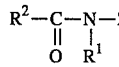

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate , myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Another preferred builder system for liquid compositions is based on dodecenyl succinic acid.

Preferred builder systems for use in granular compositions include a mixture of a water-insoluble aluminosilicate builder such as zeolite A, and a water-soluble carboxylate chelating agent such as citric acid.

Other builder materials that can form part of the builder system for use in granular compositions for the purposes of this invention include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

The compositions of the present invention should be free from conventional bleaching agents. Other components used in detergent compositions may be employed, such as suds boosting or depressing agents, enzymes and stabilizers or activators therefore, soil-suspending agents soil-release agents, optical brighteners, abrasives, bactericides, tarnish inhibitors, coloring agents, and perfumes. Especially preferred are combinations with enzyme technologies which also provide a type of color care benefit. Examples are cellulase for color maintenance/rejuvenation.

These components, particularly the enzymes, optical brighteners, coloring agents, and perfumes, should preferably be chosen such that they are compatible with the bleach component of the composition.

The detergent compositions according to the invention can be in liquid, paste or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 90° C., especially 20 to 60, but the catalysts are effective at up to 95° C. The pH of the treatment solution is preferably from 7 to 11, especially from 7.0 to 9.0.

The process and compositions of the invention can also be used as additive during laundry operations.

The following examples are meant to exemplify compositions of the present invention, but are not necessarily meant to limit or otherwise define the scope of the invention, said scope being determined according to claims which follow.

EXAMPLE 1

Homogeneous dye bleaching

The extent of dye oxidation was compared between a composition containing imidazole as amine base catalyst and a system without amine base catalyst.

Composition A: A detergent solution (100 mL) containing dyes (40 ppm final concentration), glucose (0.1% by weight) and a ferric tetrasulfonated tetraphenylporphin catalyst ($1\times10^{-5}$M) was prepared and its pH value adjusted to 8.0. Composition B: A detergent solution (100 mL) containing dyes (40 ppm final concentration), glucose (0.1% by weight), and ferric tetrasulfonated tetraphenylporphin catalyst ($2.5\times10^{-6}$M) and imidazole (10 mM) was prepared and its pH value adjusted to pH 8.0.

Test Method

The absorbance spectrum was recorded (350–750 nm). This region encompasses the wavelength maximum of the dyes (as noted in the table below) and the Soret band of the catalyst (414 nm). Glucose oxidase (final concentration 0.1 U/mL) was then added to the stirred solution to initiate the reaction. After 30 min the absorbance spectrum was recorded and the decrease in the absorbance maximum of the dyes noted.

Blank experiments indicated that no oxidation of the dyes occurred over the same period in the absence of catalyst or glucose oxidase.

| | | % destruction of dye | | |
|---|---|---|---|---|
| Dyes | CI # | lmax | COMP A | COMP B |
| Acid Blue 9 | 42000 | 630 nm | 13 | 53 |
| Direct blue 98 | 23155 | 570 nm | 62 | 90 |
| Direct blue 120 | 34090 | 570 nm | 50 | 83 |
| Acid blue 113 | 26360 | 595 nm | 39 | 95 |
| FD&C Red 40 | 16035 | 500 nm | 0 | 30 |
| Acid Yellow 40 | 18950 | 440 nm | 0 | 30 |

Conclusion: Even though a lower level of iron porphin catalyst is present in composition B, dyes are oxidized to a much bigger extent compared to composition A containing 4 times the iron porphin catalyst level.

EXAMPLE 2

Stability of the metallo catalysts

The stability of different porphyrins and phthalocyanines was determined in the presence of imidazole as amine base catalyst.

A detergent solution (100 mL) of glucose (0.1% by weight) and different metallo catalysts ($10\times10^{-5}$M) was prepared and the pH adjusted to 8.0. To initiate the reaction, different levels of glucose oxidase were added. The destruction of the catalyst was measured in each case by quantifying the decrease in absorption of the Soret band (414 nm). The catalyst destruction was compared with and without imidazole at different time intervals.

| | % catalyst destruction | | | | | |
|---|---|---|---|---|---|---|
| | No imidazole | | | With 10 mM imidazole | | |
| U Glox/mL | 10 min | 20 min | 30 min | 10 min | 20 min | 30 min |
| Iron Tetrasulfonated tetraphenylporphin | | | | | | |
| 0.1 | 53 | 7 | 0 | 92 | 87 | 82 |
| Hemin chloride | | | | | | |
| 0.05 | 67 | 42 | 29 | 100 | 93 | 89 |
| 0.25 | 33 | 21 | 13 | 92 | 68 | 49 |
| Iron phthalocyanine tetrasulfonated | | | | | | |
| 0.05 | 69 | 31 | 18 | 88 | 85 | 82 |
| 0.1 | 47 | 16 | 0 | 88 | 83 | 80 |

-continued

| | % catalyst destruction | | | | | |
|---|---|---|---|---|---|---|
| | No imidazole | | | With 10 mM imidazole | | |
| U Glox/mL | 10 min | 20 min | 30 min | 10 min | 20 min | 30 min |
| Mangano phthalocyanine tetrasulfonated | | | | | | |
| 0.1 | 30 | 0 | 0 | 77 | 69 | 62 |

EXAMPLE 3

Deposition of FeTPPS

A 50 mM borate buffer solution (pH 8.0) of ferric tetrasulfonated tetraphenylporphin catalyst (FeTPPS) ($10^{-5}$M, 10 ppm by weight) was prepared. The FeTPPS deposition was studied as follows: a knitted cotton fabric (~14 g) was soaked in the FeTPPS solution (100 mL) for 15 min. At the end the fabric was removed and the water squeezed out of it. A solution sample (2 mL) was taken before and after soaking. The concentration of FeTPPS in the solution was determined spectrophotometrically from the 2 ml sample by observing the absorbance peak at 414 nm (characteristic of the FeTPPS Soret band). This experimental procedure was repeated with and without imidazole (10 mM).

| solution | % Porphyrin left in solution |
|---|---|
| FeTPPS only | 50 |
| FeTPPS + Imidazole | 84 |

Conclusion: The presence of imidazole strongly reduces the tendency of FeTPPS to deposit onto fabrics.

EXAMPLE IV

A liquid dye transfer inhibiting composition according to the present invention is prepared, having the following compositions:

| | % |
|---|---|
| Linear alkylbenzene sulfonate | 10 |
| Alkyl sulphate | 4 |
| Fatty alcohol ($C_{12}$–$C_{15}$) ethoxylate | 12 |
| Fatty acid | 10 |
| Oleic acid | 4 |
| Citric acid | 1 |
| NaOH | 3.4 |
| Propanediol | 1.5 |
| Ethanol | 5 |
| Ethanoloxidase | 5 u/ml |
| Ferric tetrasulfonated tetraphenylporphin | 0.1 |
| imidazole | 3 |
| Minors | up to 100 |

EXAMPLE V

A compact granular dye transfer inhibiting composition according to the present invention is prepared, having the following formulation:

| | % |
|---|---|
| Linear alkyl benzene sulphonate | 11.40 |
| Tallow alkyl sulphate | 1.80 |
| $C_{45}$ alkyl sulphate | 3.00 |
| $C_{45}$ alcohol 7 times ethoxylated | 4.00 |
| Tallow alcohol 11 times ethoxylated | 1.80 |
| Dispersant | 0.07 |
| Silicone fluid | 0.80 |
| Trisodium citrate | 14.00 |
| Citric acid | 3.00 |
| Zeolite | 32.50 |
| Maleic acid actylic acid copolymer | 5.00 |
| DETMPA | 1.00 |
| Cellulose (active protein) | 0.03 |
| Alkalase/BAN | 0.60 |
| Lipase | 0.36 |
| Sodium silicate | 2.00 |
| Sodium sulphate | 3.50 |
| Ferric tetrasulfonated tetraphenylporphin | 0.025 |
| Glucose | 10.00 |
| Glucose oxidase | 100 u/ml |
| imidazole | 3 |
| Minors | up to 100 |

What is claimed is:

1. A dye transfer inhibiting composition comprising:

A. a metallo bleach catalyst selected from a) metallo porphin and water-soluble or water-dispersable derivatives thereof, b) metallo porphyrin and water-soluble or water-dispersable derivatives thereof, c) metallo phthalocyanine and water-soluble or water-dispersable derivatives thereof; wherein said metallo bleach catalyst is present in an amount sufficient to provide a wash solution at a concentration of from $10^{-8}$ to $10^{-3}$ molar;

B. an amine base catalyst stabilizer capable of binding the 5th ligand of the metallo bleach catalyst and capable of reducing the rate of self-destruction of said metallo bleach catalyst; said catalyst stabilizer is selected from the group consisting of imidazole compounds, pyridine compounds, alkylated pyridine compounds, pyrole compounds, $(C_2H_5)_3N$, $C_3H_7NH_2$, $(C_6H_{11})_2NH$, 1,5-diazabicyclo(4.3.0 )non-5-ene and mixtures thereof, and is present in said composition in a molar ratio of metallo bleach catalyst to catalyst stabilizer of from 1:1 to 1:5,000; and C. an enzymatic system capable of generating hydrogen peroxide present in an amount capable of yielding hydrogen peroxide at a concentration of from 0.005 to 10 ppm/min in said wash solution.

2. A dye transfer inhibiting compositions according to claim 1 wherein said amine base catalyst stabilizer is selected from imidazole and derivatives thereof.

3. A dye transfer inhibiting composition according to claim 1 wherein said amine base catalyst stabilizer is selected from pyridine and its derivatives thereof.

4. A dye transfer inhibiting composition according to claim 1 wherein said enzymatic system comprises an oxidase and as a substrate an alcohol, an aldehyde or a combination of both.

5. A dye transfer inhibiting composition according to claim 1, containing a metallo porphin derivative, wherein said iron porphin is substituted on at least one of its meso positions with a phenyl or pyridyl substituent selected from the group consisting of

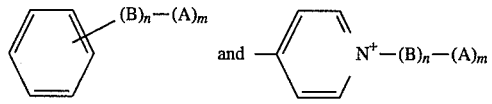

wherein n and m may be 0 or 1, A is selected from the group consisting of sulfate, sulfonate, phosphate, and carboxylate groups, and B is selected from the group consisting of $C_1$–$C_{10}$ alkyl, $C_1$–$C_{10}$ polyethoxyalkyl and $C_1$–$C_{10}$ hydroxyalkyl.

6. A dye transfer inhibiting composition according to claim 5 wherein the substituents on the phenyl or pyridyl groups are selected from the group consisting of —$CH_3$, —$C_2H_5$, —$CH_2CH_2CH_2SO_3$—, —$CH_2COO$—, —$CH_2CH(OH)CH_2SO_3$—, and —$SO_3$.

7. A dye transfer inhibiting composition according to claims 1, containing a metallo porphin derivative, wherein said metallo porphin is substituted on at least one of its meso positions with a phenyl substituent selected from the group consisting of

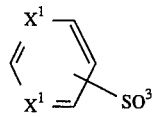

wherein $X^1$ is (=CY—) wherein each Y, independently, is hydrogen, chlorine, bromine or meso substituted alkyl, cycloalkyl, aralkyl, aryl, alkaryl or heteroaryl.

8. A dye transfer inhibiting composition according to claim 7 wherein the catalyst compound is metallo tetrasulfonated tetraphenylporphin.

9. A dye transfer inhibiting composition according to claim 1 wherein the metallo of said metallo catalyst is substituted by Fe, Mn, Co, or other transition metals.

10. A dye transfer inhibiting composition according to claim 1 wherein the concentration of metallo bleach catalyst is present in an amount sufficient to provide a wash solution concentration of from $10^{-6}$ to $10^{-4}$ molar.

11. A dye transfer inhibiting composition according to claim 4 wherein the oxidase is present by 0.1–20000 units, preferably 0.5 to 5000 units per gram of the composition.

12. A dye transfer inhibiting composition according to claim 4 wherein said substrate is glucose.

13. A dye transfer inhibiting composition according to claim 4 wherein said substrate consists of a $C_1$–$C_6$ alcohol.

14. A dye transfer inhibiting composition according to claim 10 wherein said substrate is ethanol.

15. A dye transfer inhibiting composition according to claim 4 in which the substrate is present from 0.1 to 50% by weight of the composition.

16. A dye transfer composition according to claim 11 wherein the oxidase is present at 0.5 to 5000 units per gram of the composition.

17. A dye transfer inhibiting composition according to claim 1 which is a detergent additive, in the form of a non-dusting granule or a liquid.

18. A detergent composition which comprises a dye transfer inhibiting composition according to claim 1 further comprising one or more of the following: enzymes, surfactants, builders, and other conventional detergent ingredients.

19. A process for inhibiting dye transfer between fabrics during laundering operations involving colored fabrics, said process comprising contacting said fabrics with a laundering solution containing an effective amount of the composition of claim 1.

20. A process for inhibiting dye transfer according to claim 19 which is carried out at a temperature in the range of from 5° C. to 90° C.

21. A process for inhibiting dye transfer according to claim 19 wherein the pH of the bleaching bath is from 7 to 11.

22. A process for inhibiting dye transfer according to claim 21 wherein the pH of the bleaching bath is from 7 to 9 .

* * * * *